US007713340B2

(12) United States Patent
Kawamura et al.

(10) Patent No.: US 7,713,340 B2
(45) Date of Patent: May 11, 2010

(54) PRETREATING AGENT FOR ELECTROLESS PLATING, METHOD OF ELECTROLESS PLATING USING THE SAME AND PRODUCT OF ELECTROLESS PLATING

(75) Inventors: Toshifumi Kawamura, Kitaibaraki (JP); Jun Suzuki, Kitaibaraki (JP); Toru Imori, Kitaibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 965 days.

(21) Appl. No.: 10/586,379

(22) PCT Filed: Nov. 11, 2004

(86) PCT No.: PCT/JP2004/016764

§ 371 (c)(1),
(2), (4) Date: Jul. 14, 2006

(87) PCT Pub. No.: WO2005/073431

PCT Pub. Date: Aug. 11, 2005

(65) Prior Publication Data

US 2008/0014362 A1 Jan. 17, 2008

(30) Foreign Application Priority Data

Jan. 29, 2004 (JP) ..... 2004-021128

(51) Int. Cl.
*C23C 18/28* (2006.01)

(52) U.S. Cl. ..... 106/1.11

(58) Field of Classification Search ..... 106/1.11, 106/1.18, 1.21
See application file for complete search history.

(56) References Cited

U.S. PATENT DOCUMENTS

| | | | | |
|---|---|---|---|---|
| 4,622,069 | A * | 11/1986 | Akai et al. | 106/1.11 |
| 5,894,038 | A * | 4/1999 | Sharma et al. | 427/554 |
| 6,440,576 | B1 | 8/2002 | Yamamoto et al. | |
| 6,624,070 | B2 * | 9/2003 | Merricks et al. | 438/678 |
| 6,710,181 | B2 * | 3/2004 | Kumagai et al. | 548/110 |
| 6,780,467 | B2 * | 8/2004 | Imori | 106/1.11 |
| 7,045,461 | B2 * | 5/2006 | Imori et al. | 438/678 |
| 7,179,741 | B2 * | 2/2007 | Imori et al. | 438/675 |
| 2005/0147755 | A1 * | 7/2005 | Imori et al. | 106/1.11 |
| 2007/0120880 | A1 * | 5/2007 | Kawamura et al. | 347/1 |
| 2007/0269680 | A1 * | 11/2007 | Kawamura et al. | 428/674 |

FOREIGN PATENT DOCUMENTS

| | | | |
|---|---|---|---|
| EP | 0 092 601 | A1 | 11/1983 |
| EP | 1 279 750 | | 1/2003 |
| JP | 58-189365 | | 11/1983 |
| JP | 60-110877 | | 6/1985 |
| JP | 60-195077 | | 10/1985 |
| JP | 4-215855 | | 8/1992 |
| JP | 6-256358 | | 9/1994 |
| JP | 10-317155 | | 12/1998 |
| JP | 11-256342 | | 9/1999 |
| JP | 2000-289167 | | 10/2000 |
| JP | 2001-513847 | | 9/2001 |
| JP | 2001-513848 | | 9/2001 |
| JP | 2002-317274 | | 10/2002 |
| JP | 2003-041374 | | 2/2003 |
| JP | 2003-193245 | | 7/2003 |
| WO | WO 98/38350 | | 9/1998 |
| WO | WO 01/49898 | A1 | 7/2001 |
| WO | WO 01/81652 | * | 11/2001 |
| WO | WO 02/099162 | A2 | 12/2002 |

* cited by examiner

*Primary Examiner*—Helene Klemanski
(74) *Attorney, Agent, or Firm*—Flynn, Thiel, Boutell & Tanis, P.C.

(57) ABSTRACT

The object of the present invention is to provide a pretreating agent for electroless plating that is stable and soluble in organic solvents, a method of electroless plating with excellent adhesiveness using it and an electroless plated product. An object to be plated is pre-treated using a pretreating agent for electroless plating comprising a noble metal soap of naphthenic acid or a fatty acid having 5 to 25 carbon atoms or preferably using a pretreating agent for electroless plating additionally comprising an imidazole silane coupling agent or other silane coupling agent having metal capturing ability, and then electroless plated. The noble metal soap is preferably a palladium soap.

12 Claims, No Drawings

PRETREATING AGENT FOR ELECTROLESS PLATING, METHOD OF ELECTROLESS PLATING USING THE SAME AND PRODUCT OF ELECTROLESS PLATING

TECHNICAL FIELD

The present invention relates to a pretreating agent for electroless plating that is stable and soluble in organic solvents, to a method of electroless plating using the same and to a product obtained by the electroless plating method.

BACKGROUND ART

Conventionally, colloidal solutions of tin and palladium and aqueous solutions of palladium chloride and other palladium compounds are used as catalysts in electroless plating. The problem with these catalysts is that because they use inorganic palladium compounds, when using organic solvents which have a better wettability than water and excellent applicability and workability and which can also dissolve other organic compounds such as resins, the solubility is poor and the palladium precipitates without providing a uniform solution. Palladium acetate, which is formed from a lower fatty acid, is soluble in methanol depending on the concentration, but the palladium rapidly precipitates.

DISCLOSURE OF THE INVENTION

It is an object of the present invention to provide a pretreating agent for electroless plating that is soluble in organic solvents; a method for electroless plating with excellent adhesiveness, using it; and an electroless plated product.

The inventors arrived at the present invention upon discovering that a noble metal soap obtained from a palladium compound or other noble metal compound and a fatty acid is soluble and stable in organic solvents and maintains its catalytic effect when metal is deposited from an electroless plating liquid.

That is, the present invention relates to:

(1) A pretreating agent for electroless plating comprising a noble metal soap of naphthenic acid or a fatty acid having 5 to 25 carbon atoms;

(2) The pretreating agent for electroless plating according to (1) above, further comprising a silane coupling agent having a functional group with metal capturing ability in the molecule;

(3) The pretreating agent for electroless plating according to (2) above, wherein the silane coupling agent is a silane coupling agent obtained by reacting an azole compound or amine compound with an epoxy silane compound;

(4) The pretreating agent for electroless plating according to (2) or (3) above, wherein the functional group with metal capturing ability is an imidazole group;

(5) The pretreating agent for electroless plating according to any one of (1) through (4) above, wherein the noble metal soap is a palladium soap;

(6) A pretreating agent for electroless plating according to any one of (1) through (5) above, wherein the noble metal soap is palladium naphthenate, palladium neodecanoate or palladium octylate;

(7) An ink composition comprising the pretreating agent for electroless plating according to any one of (1) through (6) above;

(8) An electroless plating method wherein an object to be plated is pre-treated with the pretreating agent for electroless plating or ink composition according to any one of (1) through (7) above and then electroless plated;

(9) The electroless plating method according to (8) above wherein pre-treatment with an ink composition is drawing with an inkjet;

(10) A plated product obtained by performing the electroless plating method according to (8) or (9) above on the object.

BEST MODE FOR CARRYING OUT THE INVENTION

The noble metal soap used in the present invention can be obtained by a reaction of naphthenic acid or a fatty acid with a noble metal compound.

The fatty acid has preferably 5 to 25, or more preferably 8 to 16 carbon atoms. If the fatty acid has not more than 4 carbon atoms it will dissolve poorly and be unstable in organic solvents. 26 carbon atoms or more is impractical because there is a limit on how much can dissolve in the organic solvent, and more needs to be added because the noble metal content is lower.

Examples of the aforementioned fatty acid include dodecanoic acid, octadecanoic acid and other saturated fatty acids, oleic acid, linoleic acid and other unsaturated fatty acids, hydroxytetradecanoic acid, carboxydecanoic acid and other oxygenated fatty acids and mixtures of these.

Desirable examples of the aforementioned fatty acid include octylic acid, neodecanoic acid, pentadecanoic acid and the like.

Examples of the aforementioned noble metal compound include compounds which are capable of forming soaps with naphthenic acid or fatty acids and which are halides, hydroxides, sulfates, carbonates and other compounds of palladium, silver, platinum, gold and other metals that have a catalytic effect in depositing copper, nickel or the like from an electroless plating liquid onto the surface of an object to be plated, and a palladium compound is particular desirable.

The noble metal soap used in the present invention can be obtained by ordinary methods of preparing metal soaps, such as the direct method or double decomposition of the aforementioned naphthenic acid or fatty acid with the aforementioned noble metal compound.

Palladium naphthenate, which is desirable as the noble metal soap used in the present invention, is shown below.

[Chemical Formula 1]

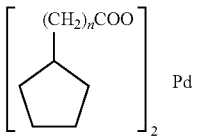

Mixture of n=9-13

Structural Formula of Palladium Naphthenate

The aforementioned noble metal soap used in the present invention is soluble in organic solvents and stable in solution. Examples of such organic solvents include butanol, 2-ethylhexanol, octyl alcohol and other alcohols, xylene and other aromatic hydrocarbons, hexane and other aliphatic hydrocarbons, and chloroform, dioxane and the like.

The noble metal soap can be used at a concentration of 1 to 30,000 mg/l or preferably 50 to 10,000 mg/l in a solution of the pretreating agent.

In addition to the aforementioned noble metal soap of a fatty acid, a silane coupling agent having in the molecule a functional group with metal capturing ability is preferably added to the electroless plating pretreating agent of the present invention. Adding this silane coupling agent allows the noble metal soap to be fixed more uniformly and more securely to the surface of the object to be plated via the silane coupling agent.

Treatment with the aforementioned silane coupling agent can be accomplished by adding the silane coupling agent to the pretreating agent comprising the noble metal soap and treating the object to be plated with the pretreating agent, or alternatively the object to be plated can be treated separately with a solution of the silane coupling agent before being treated with the noble metal soap.

The aforementioned silane coupling agent is preferably obtained by the reaction of an azole compound or amine compound with an epoxy silane compounds.

Examples of the azole compound include imidazole, oxazole, thiazole, selenazole, pyrazole, isoxazole, isothiazole, triazole, oxadiazole, thiadiazole, tetrazole, oxatriazole, thiatriazole, bendazole, indazole, benzimidazole, benzotriazole and the like. Imidazole is particularly desirable, although this is not a limitation.

Examples of the amine compound include propylamine and other saturated hydrocarbon amines, vinylamine and other unsaturated hydrocarbon amines, phenylamine and other aromatic amines and the like.

The aforementioned silane coupling agent is also a compound having in addition to the noble metal capturing group derived from the aforementioned azole compound or amine compound the group —SiX1X2X3 wherein X1, X2 and X3 are alkyl groups, halogens, alkoxy groups or the like and may be functional groups capable of fixing on the object to be plated. X1, X2 and X3 may be the same or different.

The aforementioned silane coupling agent can be obtained by reacting the aforementioned azole compound or amine compound with an epoxy silane compound.

This epoxy silane compound is preferably the epoxy silane coupling agent shown by the following formula:

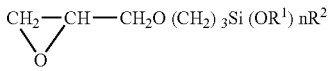

(3-n)

(wherein $R^1$, and $R^2$ are hydrogen atoms or alkyl groups with 1 to 3 carbon atoms, and n is 0 to 3).

The aforementioned azole compound and epoxy group-containing silane compound can be reacted for example under the conditions described in Japanese Patent Publication No. 6-256358A.

For example, 0.1 to 10 moles of the epoxy group-containing silane compound can be dripped into 1 mole of the azole compound at 80 to 200° C. and then reacted for 5 minutes to 2 hours. In this case a solvent is not particularly necessary but an organic solvent such as chloroform, dioxane, methanol, ethanol or the like may be used.

A particular desirable example of a reaction between imidazole and an epoxy silane compound is shown below:

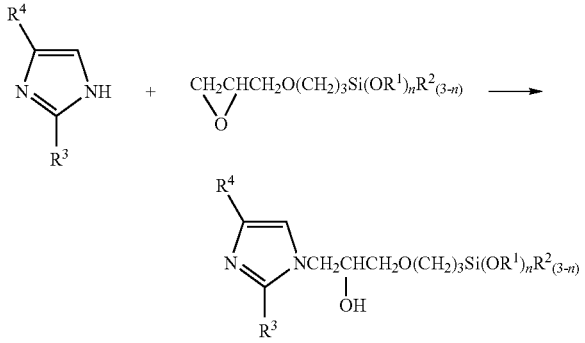

(wherein $R^1$ and $R^2$ are hydrogen or an alkyl group with 1 to 3 carbon atoms, $R^3$ is hydrogen or an alkyl group with 1 to 20 carbon atoms, $R^4$ is a vinyl group or alkyl group with 1 to 5 carbon atoms and n is 0 to 3).

Other examples of the silane coupling agent having a functional group with metal capturing ability used in the present invention include γ-aminopropylmethoxysilane, γ-aminopropyltriethoxysilane, N-β(aminoethyl)γ-aminopropyltrimethoxysilane, N-β(aminoethyl)γ-aminopropyltriethoxysilane, γ-mercaptopropyltrimethoxysilane and the like.

In the present invention it is vital that the pretreating agent contain a noble metal soap of naphthalene or a fatty acid, but it may also contain conventional tin chloride or other catalysts within the range of the intent of the present invention.

The pretreating agent for electroless plating of the present invention can be applied to an object to be plated as an ink composition using an inkjet system. Viscosity adjusters, surface tension agents and other additives are preferably added in this case to fulfill the requirements of the ink.

Using the metal plating method of the present invention there are no restrictions on the nature of the object to be plated. Examples include glass, ceramics and other inorganic materials, polyester, polyamide, polyimide, fluorine resin and other plastic materials and films, sheets and fibers of these, and insulators such as insulating plates of epoxy resin and the like reinforced with glass fiber backings are also possible as are objects with low conductivity such as Si wafers and other semiconductors, and the method of the present invention can be applied favorably even if the object to be plated is a mirror object such as a transparent glass plate, Si wafer or other semiconductor substrate or even if it is a powder. Examples of such powders include glass beads, molybdenum disulfide powder, magnesium oxide powder, graphite powder, SiC powder, zirconium oxide powder, alumina powder, silicon oxide powder, mica flakes, glass fiber, silicon nitride, Teflon™ powder and the like.

When the substrate is in cloth or plate form the normal method is to coat the surface by dipping, brush painting or the like and then volatilize the solvent, but this is not a limitation and the method can be any by which the silane coupling agent is made to adhere uniformly to the surface. In the case of a powder, in addition to a method of volatilizing the solvent after dipping to force a silane coupling agent contained in a solution to adhere to the surface of a substrate, since the silane coupling agent is capable of adhering to the surface of the substrate during dipping treatment because of its uniform film-forming ability it is possible to simply remove the solvent by filtration after treatment and dry the wet powder. Depending on the adhesion state, water washing may be sufficient without a drying step.

Although not limited thereby, the concentration of the silane coupling agent having metal capturing ability in the treating solution is preferably 0.001 to 10% by weight. Below 0.001% by weight, the amount of the compound adhering to the surface of the base may be too low, and the effects will be difficult to obtain. Above 10% by weight too much adheres, making drying difficult and increasing the likelihood of powder aggregation.

To volatilize the solvent used in surface treatment, it is sufficient to dry the surface by heating it to a temperature at or above the volatilization temperature of the solvent, and preferably it is heated at 60 to 120° C. for 3 to 60 minutes.

In the electroless plating method of the present invention, an object to be plated which has been pre-treated as described above can then be electroless plated by ordinary methods. In this way, an electroless plated object can be obtained having a uniform and highly adhesive electroless film coating of copper, nickel, tin, silver or the like for example.

EXAMPLES

The present invention is explained in detail below using examples.

Example 1

A butanol plating pretreating agent was prepared with 500 ml/L of tin chloride and 500 mg/L of palladium naphthenate (manufactured by Nikko Materials Co., Ltd., 60 mg/L as palladium). A glass substrate was immersed for 10 minutes at 60° C. in this solution, washed under running water, and heat treated for 15 minutes at 100° C. in atmosphere. This was cooled to room temperature, and the electroless nickel plating liquid Nikom 7N-0 (manufactured by Nikko Metal Plating, Co., Ltd.) was heated to 70° C. and plated for 5 minutes. The electroless copper plating liquid KC500 (manufactured by Nikko Metal Plating, Co., Ltd.) was then applied to provide a plating thickness of 1 μm. When the adhesiveness of the copper plating film was tested, the peel strength was 0.9 kgf/cm$^2$, indicating strong adhesiveness.

Example 2

A 2-ethyl hexanol system plating pretreating agent was prepared with 500 mg/L of palladium naphthenate (manufactured by Nikko Materials Co., Ltd., 60 mg/L as palladium) and 500 mg/L of a silane coupling agent which was the reaction product of equal molar amounts of imidazole and γ-glycidoxypropyltrimethoxysilane. A glass-epoxy substrate was immersed for 10 minutes at 60° C. in this liquid, washed under running water and heat treated for 15 minutes at 100° C. in atmosphere. This was cooled to room temperature, and the electroless nickel plating liquid Nikom 7N-0 (manufactured by Nikko Metal Plating Co., Ltd.) was heated to 70° C. and plated for 5 minutes. The electroless copper plating liquid KC500 (manufactured by Nikko Metal Plating Co., Ltd.) was then applied to provide a plating thickness of 1 μm. When the adhesiveness of the copper plating film was tested, the peel strength was 1.3 kgf/cm$^2$, indicating strong adhesiveness.

Example 3

γ-aminopropyl trimethoxysilane was added to 2 g/L and palladium octylate (manufactured by Nikko Materials Co., Ltd., 300 mg/L as palladium) to 3 g/L to prepare an octyl alcohol system plating pretreating agent.

A glass plate was immersed for 30 minutes at 60° C. in this liquid, washed under running water and heat treated for 20 minutes at 150° C. in atmosphere. This was plated for 10 minutes with the electroless nickel plating liquid Nikom 7N-0 (manufactured by Nikko Metal Plating Co., Ltd.) heated to 70°, to a plating thickness of 1 μm. Adhesiveness was high, with a peel strength of 1.2 kgf/cm$^2$.

Example 4

A polyimide film was dipped at room temperature in an aqueous solution containing 5 g/L of a silane coupling agent which was a reaction product of equal molar amounts of imidazole and γ-glycidoxypropyltrimethoxysilane. After being washed in running water, this was dipped in a xylene solution containing 10 g/L of palladium naphthenate (manufactured by Nikko Materials Co., Ltd., 1.2 g/L as palladium). It was then heat treated for 15 minutes at 100° C. in atmosphere, and cooled to room temperature. The electroless nickel plating liquid Nikom 7N-0 (manufactured by Nikko Metal Plating Co., Ltd.) was then heated to 70° C. and applied for 5 minutes. The electroless copper plating liquid KC500 (manufactured by Nikko Metal Plating Co., Ltd.) was then applied to provide a plating thickness of 1 μm. When the copper plating film was tested for the adhesiveness, it showed a high adhesiveness, with a peel strength of 1.3 kgf/cm$^2$.

Example 5

(a) A silane coupling agent which was the reaction product of equal molar amounts of imidazole and γ-glycidoxypropyltrimethoxysilane and (b) palladium neodecanoate (manufactured by Nikko Materials Co., Ltd.) were mixed to prepare a 2-ethylhexanol solution. A viscosity adjuster and a surface tension agent were added to the solution to prepare an ink containing 1 g/L of (a) and 1 g/L of (b) (100 mg/L as palladium). This was ejected from an inkjet nozzle to draw a wiring circuit on a polyimide film substrate. After being air dried, this was plated with the electroless nickel plating liquid Nikom 7N-0 (manufactured by Nikko Metal Plating Co., Ltd.). The electroless copper plating liquid KC500 (manufactured by Nikko Metal Plating Co., Ltd.) was then applied to provide a plating thickness of 1 μm. Cross-sectional observation by SEM showed that wiring had formed with clear plating boundaries and no extra-pattern deposition.

Example 6

10 g/L of palladium naphthenate (manufactured by Nikko Materials Co., Ltd., 1.2 g/L as palladium) was added to 10 g/L of a reaction product of equal molar amounts of imidazole and γ-glycidoxypropyltrimethoxysilane to prepare an octyl alcohol solution. This solution was stable for 1 month or more at room temperature.

Comparative Example 1

A butanol-system plating pretreating agent was prepared with 500 mg/L of tin chloride and 500 mg/L of palladium chloride (300 mg/L as palladium). A glass plate was dipped for 10 minutes at 60° C. in this liquid, washed in running water and heat treated for 15 minutes at 100° C. in atmosphere. After being cooled to room temperature, this was plated for 5 minutes with the electroless nickel plating liquid Nikom 7N-0) (manufactured by Nikko Metal Plating Co., Ltd.) heated to 70° C. The electroless copper plating liquid KC500 (manufactured by Nikko Metal Plating Co, Ltd.) was then applied to provide a plating thickness of 1 μm. When the adhesiveness of the copper plate was tested, the peel strength was 0.3 kgf/cm$^2$. The palladium precipitated out of this pretreating agent within 5 hours at room temperature.

Comparative Example 2

1 g/L of palladium acetate (0.5 g/L as palladium) was added to 1 g/L of a reaction product of equal molar amounts of imidazole and γ-glycidoxypropyltrimethoxysilane to prepare an octyl alcohol solution. The palladium precipitated out of this solution within about 5 minutes at room temperature, and it could not be used as a pretreating agent.

INDUSTRIAL APPLICABILITY

The electroless plating pretreating agent of the present invention is soluble in organic solvents and is extremely stable in those solvents. Such a solution also has excellent applicability and workability with respect to objects to be plated, and can be drawn as an ink with an inkjet. Consequently, it allows electroless plating even on the objects which had heretofore difficulty in plating. It can also form a plating film that is highly uniform and adhesive.

The invention claimed is:

1. A pretreating agent for electroless plating comprising a noble metal soap of naphthenic acid or a fatty acid having 5 to 25 carbon atoms and further comprising a silane coupling agent having a functional group with metal capturing ability in the molecule.

2. The pretreating agent for electroless plating according to claim 1, wherein the silane coupling agent is a silane coupling agent obtained by reacting an azole compound or amine compound with an epoxysilane compound.

3. The pretreating agent for electroless plating according to claim 1, wherein the functional group with metal capturing ability is an imidazole group.

4. The pretreating agent for electroless plating according to claim 1 wherein the noble metal soap is a palladium soap.

5. The pretreating agent for electroless plating according to claim 1, wherein the noble metal soap is palladium naphthenate, palladium neodecanate or palladium octylate.

6. An ink composition comprising the pretreating agent for electroless plating according to claim 1.

7. The pretreating agent for electroless plating according to claim 1, additionally comprising an organic solvent.

8. An electroless plating method comprising the step of pre-treating an object to be plated with the pretreating agent of claim 1 and then performing electroless plating of the object.

9. A plated object obtained by the electroless plating method of claim 8.

10. An electroless plating method comprising the step of pre-treating an object to be plated with the ink composition of claim 7 and then performing electroless plating of the object.

11. The electroless plating method according to claim 10, wherein pre-treatment of the object with the ink composition comprises drawing with an inkjet.

12. A plated object obtained by the electroless plating method of claim 10.

* * * * *